US006451749B1

(12) United States Patent
Murphy et al.

(10) Patent No.: US 6,451,749 B1
(45) Date of Patent: Sep. 17, 2002

(54) CARE BOOSTER COMPOSITION FOR SUPPLEMENTING THE PERFORMANCE OF LAUNDRY COMPOSITIONS

(75) Inventors: Dennis Stephen Murphy, Wyckoff, NJ (US); Michael Orchowski, Nutley, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/999,652

(22) Filed: Oct. 26, 2001

(51) Int. Cl.[7] ..... C11D 9/36; C11D 3/382

(52) U.S. Cl. ..... 510/287; 510/283; 510/466; 510/487; 510/515; 510/516; 510/521; 510/251; 510/347; 510/353; 510/437

(58) Field of Search ..... 510/283, 287, 510/466, 487, 515, 516, 521, 251, 347, 353, 437

(56) References Cited

U.S. PATENT DOCUMENTS

| | | | | | |
|---|---|---|---|---|---|
| 4,800,026 | A | * | 1/1989 | Coffindaffer et al. | 252/8.8 |
| 4,911,852 | A | * | 3/1990 | Coffindaffer et al. | 252/8.8 |
| 5,064,543 | A | * | 11/1991 | Coffindaffer et al. | 252/8.6 |
| 5,695,677 | A | * | 12/1997 | Silvester et al. | 252/8.91 |
| 5,798,107 | A | * | 8/1998 | Vogel et al. | 424/400 |
| 5,965,517 | A | * | 10/1999 | Mooney | 510/516 |
| 5,968,404 | A | * | 10/1999 | Trinh et al. | 252/8.91 |

FOREIGN PATENT DOCUMENTS

| | | | |
|---|---|---|---|
| WO | 00/24853 | * | 5/2000 |
| WO | 00/24857 | * | 5/2000 |
| WO | 00/44423 | | 8/2000 |

* cited by examiner

*Primary Examiner*—Charles Boyer
(74) *Attorney, Agent, or Firm*—Edward A. Squillante, Jr.

(57) ABSTRACT

The invention is directed to a care booster composition effective for reducing wrinkles in a fabric being washed. The care booster composition enhances the performance of laundry detergents and fabric conditioners and may be used in processes for cleaning cloths.

9 Claims, No Drawings

CARE BOOSTER COMPOSITION FOR SUPPLEMENTING THE PERFORMANCE OF LAUNDRY COMPOSITIONS

FIELD OF THE INVENTION

The present invention is directed to a care booster composition for supplementing the performance of laundry compositions. More particularly, the present invention is directed to a composition that improves the characteristics of fabrics by supplementing the performance of laundry detergents, fabric conditioners or both in a washing process.

BACKGROUND OF THE INVENTION

It is generally desired to remove, from washing machines, fabrics, like clothing or linens, that but for drying, require little to no work before being worn. For example, it is desirable to wash clothing in a washing machine and remove the clothing from the washing machine without having to iron the clothing with a mechanical ironing device prior to use. In addition to being substantially wrinkle free, it is very desirable to machine wash fabrics in a washing machine to obtain clean fabrics that, among other things, are soft to the touch, odor free and freshly scented.

Attempts have been made to formulate conventional laundry compositions that result in fabrics displaying improved characteristics, such as fabrics with improved softness characteristics and less wrinkles. However, such compositions are difficult to formulate because the components that are needed to enhance fabric characteristics are not always compatible with the compounds that typically make up the conventional laundry compositions. Thus, conventional laundry compositions, such as laundry detergents and fabric conditioners, that do significantly more than their intended norm are not readily available.

It is of increasing interest to develop a composition that may be used in a washing machine to improve the characteristics of fabrics being washed. This invention, therefore, is directed to a care booster composition for supplementing the performance of laundry compositions. The care booster composition is stable, and capable of being used in any washing process.

ADDITIONAL INFORMATION

Efforts have been disclosed for making compositions that improve the characteristics of laundered items. In WO 00/24857, laundry detergent products with wrinkle reducing ingredients are disclosed.

Other efforts have been disclosed for improving the characteristics of laundered items. In WO 00/24853, fabric softening products with wrinkle reducing ingredients are disclosed.

Even other efforts have been disclosed for making compositions that improve the characteristics of laundered fabrics. In WO 00/44423, compositions with dye fixing agents are disclosed.

None of the references above disclose a care booster composition that supplements the performance of laundry compositions, especially with respect to reducing wrinkles.

SUMMARY OF THE INVENTION

In a first aspect, the present invention is directed to a care booster composition comprising an ingredient effective for reducing wrinkles in a fabric.

In a second aspect, the present invention is directed to a method for washing fabrics with the care booster composition of the present invention.

As used herein, ingredient effective for reducing wrinkles in a fabric is not water. Care booster composition, as used herein, is defined to mean an aqueous or non-aqueous composition which is not a laundry detergent, fabric conditioner or shampoo composition, and which is a composition for use with fabrics and comprising an ingredient effective for reducing wrinkles in a fabric.

DETAILED DESCRIPTION OF THE PREFERRED EMBODIMENTS

There is no limitation with respect to the type of ingredient effective for reducing wrinkles in a fabric that may be used in this invention other than that the ingredient is one which may be used when washing fabrics. Typically, such an ingredient is a non-hydrophillically modified or hydrophillically modified compound having a weight average molecular weight of at least about 150 and suitable for lubricating the fibers of a fabric.

Illustrative examples of the ingredient effective for reducing wrinkles in a fabric that may be used include non-hydrophillically modified or hydrophillically modified ingredients like oils, animal derived solids, waxes, silicon comprising compounds, mixtures thereof and the like. The oils which may be used in this invention include those generally classified as triglycerides and branched hydrocarbons. Examples of plant oils that may be used include castor, peanut, corn, palm, tall oil, mixtures thereof and the like. Animal oils such as fish oil may also be used as the ingredient effective to reduce wrinkles in a fabric, and mineral oil may be used as well. The animal derived solids which may be used in this invention include lard and tallow. As to the waxes which may be used as the ingredient effective for reducing wrinkles in a fabric, such waxes include lanolin wax, paraffin wax and carnuba wax.

The silicon comprising compounds which may be used in this invention include silanes, and especially, siloxanes.

The silanes which may be used in this invention include, for example, trialkoxyalkyl silanes like trimethoxydodecyl silane and trimethoxyoctadecyl silane, mixtures thereof, and the like.

The siloxanes which may be used in this invention as the ingredient effective for reducing wrinkles in a fabric include polysiloxanes comprising in its backbone structural units having the formula:

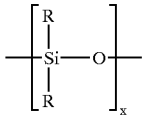

wherein each R is independently a hydrogen, alkyl, aryl, alkenyl, akaryl, arakyl, cycloalkyl, or halogenated hydrocarbon group when the polysiloxane is non-hydrophillically modified. When hydrophillically modified, at least one R is an amino, amide (including lactam), mono-, oligo-, or polysaccharide, carboxylic acid, ester (including lactone), hydroxy, alkoxy, alkyleneoxide, sulfate, sulfonate, phosphate, phosphonate or monovalent betaine. Typically, x is an integer from about 5 to about 10,000, and the polysiloxane may be terminated by any of the groups represented by R.

Examples of the alkyl group which may be used include $C_{1-C12}$ alkyl groups, and the like. The alkenyl groups which may be used include vinyl and allyl groups, and the like. The aryl groups which may be used include phenyl, diphenyl and naphthyl groups, and the like. The alkaryl groups which may be used include toyl, xylyl and ethylphenyl groups and the like. The aralkyl groups include benzyl, alphaphenylethyl, betaphenylethyl and alpha-phenylbutyl groups, and the like. Cycloalkyl groups which may be used include cyclobutyl and cyclopentyl groups, and the like. The halogenated hydrocarbon groups that may be used include chloromethyl and bromoethyl groups, and the like. The alkyleneoxide groups include ethyleneoxide groups, propylene oxide groups and copolymers thereof.

Other types of siloxanes which may be used in this invention include those classified as linear polysiloxanes such as linear aminopolydimethylsiloxanes. These types of siloxanes are described in U.S. Pat. No. 4,150,048, the disclosure of which is incorporated herein by reference.

The ingredients effective for reducing wrinkles in a fabric may be made by conventional chemical processes. Such ingredients are also made commercially available by suppliers like General Electric Company, Dow Chemical, B.F. Goodrich Company and Crompton/Witco. In a preferred embodiment, the ingredient effective for reducing wrinkles in a fabric used in this invention is a siloxane sold commercially by Crompton/Witco under the names Silwet L-7602, L7622, L8610, L8620, and dimethylsilicone fluid L-45.

Regarding the amount of ingredient effective for reducing wrinkles in a fabric used in the care booster composition of the present invention, typically from about 0.5 to about 50.0%, and preferably, from about 1.0 to about 35.0%, and most preferably, from about 2.0 to about 20.0% by weight of ingredient effective for reducing wrinkles in a fabric is used, based on total weight of the care booster composition and including all ranges subsumed therein.

Optional additives which may be used in this invention include, but are not limited to, dye fixing agents, dye transfer inhibitors, metal ion scavengers, odor reducing agents, wear reducing agents, anti-microbial agents, insect repellents, UV absorbers, anti-redeposition agents and enzymes.

The dye fixing agents that may be used in this invention often work by minimizing the loss or removal of dye from the fabrics being washed. Such a dye fixing agent is often cationic and comprises a quaternized nitrogen. Illustrative examples of the dye fixing agents that may be used in the present invention include fatty acid-diamine condensates, like the hydrochloride, acetate, metasulphate and benzyl hydrochloride of oleyldiethylaminoethylamide, oleylmethyidiethylene-diaminemethosulphate, and monostearyl-ethylene diaminotrimethylammonium methosulphate, mixtures thereof, and the like.

Other dye fixing agents that may be used in this invention include derivatives of polymeric alkyldiamines, polyaminecyanuric chloride condensates, aminated glycerol dichlorohydrins, mixtures thereof and the like.

The dye fixing agents that may be used in this invention are made commercially available by, for example, Ciba Specialty Chemicals under the names Tinofix CL, ECO, RTM, and RTM.FRD; and Rhodia under the name Mirapol A-15; and Burlington Chemical under the names Burofix NF and Burcoterg; and Crosfield Noff under the name Croscolor PMF; and Sandoz under the names Sandofix TPS and Sandofix SWE; and CHT-Beitlich GMBH under the names Rewin SRF, Rewin SRF-O and Rewin DWR.

The dye fixing agents typically make up from about 0.0 to about 50.0%, and preferably, from about 0.5 to about 30.0%, and most preferably, from about 3.0 to about 20.0% by weight of the total weight of care booster composition, including all ranges subsumed therein.

Regarding the dye transfer inhibitors that may be used in the present invention, such as agents are limited only to the extent that they may be used in a fabric washing process. Illustrative examples of the dye transfer agents which may be used in the present invention include, for example, those generally classified as N-heterocyclic polymers. Illustrative examples of the dye transfer agents which may be used in this invention include PVP N-oxide polymers, N-vinyl pyrrolidone, N-vinyl imidazole, polyvinyl pyrrolidone, polyvinyl oxazoladones, polyvinyl imidazoles, 4-vinyl pyridine polymers, 2-vinyl pyrridine polymers, copolymers thereof, or mixtures thereof, and the like.

Other dye transfer inhibitors which may be used in this invention include alkali metal or ammonium salts of poly (N-carboxymethyl-4-vinyl pyrrodine) chloride. The sodium salt of such an agent may be obtained commercially from ISP Chemical Corporation under the name Chromabond S-100. Yet another dye transfer agent which may be used in this invention includes PVP homopolymer which is made commercially available from BASF. Regarding the dye transfer inhibiting agents that may be used in this invention, it is within the scope of the invention for such agents to be quaternized or non-quaternized.

The dye transfer inhibitors typically make up from about 0.0 to about 15.0%, and preferably, from about 0.1 to about 10.0%, and most preferably, from about 0.3 to about 5.0% by weight of the total weight of care booster composition, including all ranges subsumed therein.

When using the dye fixing agents and dye transfer inhibitors in compositions employable with fabrics, such as the care booster compositions of this invention, the isolation or separation of colored fabrics from white fabrics is not required prior to washing.

The metal scavenging agents that may be used in this invention include, for example, any of those which may be used in a fabric washing process. Such metal scavenging agents include, for example, amino carboxylic acids and amino phosphonic acids, including salts thereof, mixtures thereof and the like. Examples of amino carboxylates that may be used in this invention include ethylenediaminetetraacetates, N-hydroxyethylethylenediamine triacetates, nitrilotriacetates, ethylenediamine tetrapropionates and triethylenetetraaminedisuccinates, and preferably, the alkali metal salts of such metal scavenging agents.

Examples of the aminophosphonates which may be used in this invention include ethylenediaminetetrakis (methylene-phosphonates) such as those made available by Solutia Inc., under the name Dequest.

Other metal scavenging agents which may be used include iminodisuccinic acid, dipicolinic acid, hydroxyethyidiphosphonic acid, diethylene triamine pentaacetic acid, salts thereof, mixtures thereof and the like. The preferred metal scavenging agents are, however, ethylene diamine disuccinic acid, dipicolinic acid, mixtures thereof, salts thereof and the like.

The metal scavenging agent which may be used in the care booster composition of the present invention typically makes up from about 0.0 to about 8.0%, and preferably, from about 0.01% to about 5.0% by weight of the total weight of care booster composition, including all ranges subsumed therein.

The odor-reducing agents which may be used in this invention include, for example, ricinoleates, like zinc ricinoleates, and perfumes, including those often classified as deo perfumes such as those described in U.S. Pat. No. 6,074,672, the disclosure of which is incorporated herein by reference.

Other odor reducing agents which may be used in the care booster composition of the present invention includes cyclodextrins, such as those described in U.S. Pat. Nos. 5,139,687 and 5,384,186, the disclosures of which are incorporated herein by reference.

Typically the odor reducing agents make up from about 0.0 to about 15.0%, and preferably, from about 0.5 to about 10.0% by weight of the total weight of care booster composition, including all ranges subsumed therein.

The wear reducing agents which may be used in the composition of this invention include, for example, waxes like Paraflints, made commercially available by Schumann Sasol, and wheat proteins like Dragoderm, made commercially by Dragoco. Such wear reducing agents generally make up from about 0.0 to about 5.0% by weight of the total weight of care booster composition.

The antimicrobial agents which may be used in the composition of this invention include biguanides like 1,1'-hexamethylene bis(5-(p-chlorophenyl) biguanide) (e.g., chlorhexidine) and salts thereof. Other antimicrobial agents include quaternary ammonium compounds like benzalkonium chlorides, N-(3-choroallyl) hexaminium chlorides, benzethonium. chloride, methylbenzethonium chloride, cetylpyridinium chloride, mixtures thereof and the like.

The antimicrobial agents typically make up from about 0.0 to about 3.0% by weight of the total weight of care booster composition.

The insect repellents which may be used in this invention include catnip, perfume ingredients (like citronellol, citronellal, citral), linalool, sandalwood oil, cedar extract, geranium oil, 2-(diethylphenoxy) ethanol, 1-dodecene, mixtures thereof, and the like. Such repellants typically make up from about 0.0 to about 10.0% by weight of the total weight of care booster composition.

The enzymes which may be used in this invention include those typically used in fabric washing processes. Such enzymes are often made commercially available from suppliers like Genencor International Inc. and Novo Nordisk A/S. The enzymes are generally selected from the group consisting of amylases, proteases, lipases and cellulases, with cellulase being especially preferred. Such cellulases which may be used include Celluclast, made available from Novo Nordisk A/S, and Cytolase 123 made available from Genencor International, Inc. Other cellulases which may be used in this invention are disclosed in U.S. Pat. No. 6,300,122, the disclosure of which is incorporated herein by reference. The enzyme or mixture of enzymes used in this care booster composition of this invention generally make up less than about 5.0%, and preferably, from about 0.001 to about 4.0% by weight of the total weight of care booster composition.

The UV absorbers which may be used in this invention include commercially available fluorescent and photofading inhibitors like sunscreens, UV inhibitors, anti-oxidants octyl dimethylpara-aminobenzoic acid, benzophenone-3, mixtures thereof and the like. Other UV absorbers include modified polysaccharide materials like those disclosed in U.S. Pat. No. 6,248,710, the disclosure of which is incorporated herein by reference. Such absorbers typically make up from about 0.0 to about 5.0% by weight of the total weight of care booster composition.

As to the anti-redeposition agents that may be used in this invention, such agents are commercially available and are typically selected from the group consisting of cellulosic polymers, polyethylene glycol and polyacrylates. The anti-redeposition agents make up from about 0.0 to about 25.0%, and preferably, from about 0.01 to about 20.0% by weight of the total weight of care booster composition.

Even further optional ingredients which may be used in this invention include preservatives like Kathon CG (Rohm & Haas), Glydant Plus (Lonza) and Urcarcide 250 (Dow Chemical); and thickeners like Acusol (Rohm & Haas), xanthan gums sold in the Keizan series by (CP Kelco) and hydroxethylcelluloses like the Natrosol series made available from Hercules Chemical; and pH modifiers like sodium and potassium hydroxide. Such other optional ingredients, collectively, make up less than 5.0% by weight of the total weight of the care booster composition.

The care booster composition of this invention may be in the form of a tablet, powder, gel or liquid (including an emulsion). Therefore, the care booster composition of this invention may be aqueous or non-aqueous. Preferably, however, the care booster composition of the present invention is a liquid and aqueous with water being added as the balance.

When preparing the care booster composition of the present invention in liquid form, for example, the components (e.g., ingredient effective for reducing wrinkles in a fabric and water) are mixed under conditions of moderate shear, and typically, at about atmospheric pressure and ambient temperature. In a preferred embodiment, the care booster composition of the present invention will also comprise a dye fixing agent and a dye transfer inhibitor.

When using the care booster composition of the present invention, the composition may be added to, for example, a fabric washing machine at any time during the fabric washing process; and preferably, during or before the rinsing cycle; and most preferably, during or before the washing cycle, or both. Thus, it is within the scope of this invention to instruct a user to add the care booster composition of this invention to a washing process to about the time when the laundry detergent is added to the fabric washing process or at about the time fabric conditioner is added to the fabric washing process, or both.

When adding the care booster composition to the fabric washing process, the amount added typically results in a solution (e.g., washing solution or rinsing solution such as those found in a domestic washing machine) having from about 0.025 to about 1.0 g/l; and preferably, from about 0.05 to about 0.60 g/l; and most preferably, from about 0.075 to about 0.40 g/l ingredient effective for reducing wrinkles in a fabric.

In an especially preferred embodiment, when the care booster composition is added to the washing process, the amount of dye fixing agent in the solution is about the same as the amount of ingredient effective for reducing wrinkles in a fabric. Also, in an especially preferred embodiment, the amount of dye transfer inhibitor added to the solution is about 0.005 to about 1.0 g/l and preferably, from about 0.01 to about 0.80 g/l, and most preferably, from about 0.015 to about 0.5 g/l.

In another especially preferred embodiment, emulsifiers may be used in the care booster composition of this invention. Such emulsifiers typically are added to the care booster composition to produce an emulsifier-to-ingredient effective for reducing wrinkles in a fabric at a ratio of about 1:5 to 5:1, and preferably, from about 1:4 to 4:1. Such emulsifiers are desired when at least about 50%, and preferably, at least about 80% by weight of the total ingredient effective for reducing wrinkles in a fabric is water insoluble and an aqueous care booster composition is desired.

The emulsifier or emulsifier mixtures (i.e., emulsifying system) used in this invention preferably have an HLB from about 8 to about 12, and preferably, from about 9 to about 10. Examples are those generally classified as nonionic stearates like Tween 60 and Span 60, both made commercially available by ICI. Cationic emulsifiers like cetyltrimethylammonium chlorides (e.g., Arquad 16/50, from Akzo-Nobel) and polyalkelane amine quats (e.g., Atlas G-250, from ICI) may also be used.

Other emulsifiers which may be used include sulfonated glyceryl esters of fatty acids, salts of sulfonated monovalent alcohol esters, amides of sulfonic acids, 2, 6, 8-tirmethyl-4-nonyloxypolyethyleneoxyethanol, mixtures thereof, and the like.

It is also within the scope of this invention to sell the care booster composition of this invention with instructions to use the same with a laundry detergent and not in lieu of a laundry detergent. Moreover, it is also within the scope of this invention to sell a kit comprising the care booster composition of this invention and laundry detergent, fabric conditioner or both.

The examples below are provided to facilitate an understanding of the present invention. The examples are not intended to limit the scope of the invention as described in the claims.

EXAMPLE 1

| Ingredient - Chemical Name | Percent in Formula (Based on 100% Active Raw) |
|---|---|
| Dimethyl silicone fluid L-45 (1000 cSt) | 7–10 |
| Span 60 nonionic surfactant | 1–2 |
| Tween 60 nonionic surfactant | 3–6 |
| Acusol thickener | 0.5–1 |
| Sodium hydroxide | 0.1–0.3 |
| Kathon CG | 0.0005–0.001 |
| Fragrance | 0.1–1.0 |
| Water | to 100 |

EXAMPLE 2

| Ingredient - Chemical Name | Percent in Formula (Based on 100% Active Raw) |
|---|---|
| Dimethyl silicone fluid L-45 (1000 cSt) | 7–10 |
| Span 60 nonionic surfactant | 1–2 |
| Tween 60 nonionic surfactant | 3–6 |
| Tinofix ECO | 7–12 |
| Chromabond | 0.75–3 |
| Iminodisuccinate | 0.0–1 |
| Xanthan gum | 0.5–1 |
| Kathon CG | 0.0005–0.001 |
| Fragrance | 0.1–1.0 |
| Water | to 100 |

EXAMPLE 3

| Ingredient - Chemical Name | Percent in Formula (Based on 100% Active Raw) |
|---|---|
| Dimethyl silicone fluid L-45 (10000 cSt) | 7–10 |
| Span 60 nonionic surfactant | 1–2 |
| Tween 60 nonionic surfactant | 3–6 |
| Acusol thickener | 0.5–1 |
| Sodium hydroxide | 0.1–0.3 |
| Kathon CG | 0.0005–0.001 |

-continued

| Ingredient - Chemical Name | Percent in Formula (Based on 100% Active Raw) |
|---|---|
| Fragrance | 0.1–1.0 |
| Water | to 100 |

EXAMPLE 4

| Ingredient - Chemical Name | Percent in Formula (Based on 100% Active Raw) |
|---|---|
| Dimethyl silicone fluid L-45 (10000 cSt) | 7–10 |
| Span 60 nonionic surfactant | 1–2 |
| Tween 60 nonionic surfactant | 3–6 |
| Tinofix ECO | 7–12 |
| Chromabond | 0.75–3 |
| Iminodisuccinate | 0.0–1 |
| Xanthan gum | 0.5–1 |
| Kathon CG | 0.0005–0.001 |
| Fragrance | 0.1–1.0 |
| Water | to 100 |

EXAMPLE 5

| Ingredient - Chemical Name | Percent in Formula (Based on 100% Active Raw) |
|---|---|
| Sulphated castor oil | 7–10 |
| Kathon CG | 0.0005–0.001 |
| Fragrance | 0.1–1.0 |
| Water | to 100 |

EXAMPLE 6

| Ingredient - Chemical Name | Percent in Formula (Based on 100% Active Raw) |
|---|---|
| Sulphated castor oil | 7–10 |
| Tinofix ECO | 7–12 |
| Chromabond | 0.75–3 |
| Iminodisuccinate | 0.0–1 |
| Kathon CG | 0.0005–0.001 |
| Fragrance | 0.1–1.0 |
| Water | to 100 |

The examples depict stable care booster compositions that may be made by mixing ingredients, in no particular order, under conditions of moderate shear. The care booster compositions may be used in a fabric washing process to enhance the performance of laundry detergents and fabric conditioners and reduce wrinkle formation in fabrics, like clothing, being washed.

What is claimed is:

1. A method for reducing wrinkles in a fabric comprising the steps of contacting a fabric with water in a washing process;

contacting the fabric with a laundry detergent, fabric conditioner, or both; and contacting the fabric with a care booster composition comprising an ingredient effective for reducing wrinkles in the fabric selected from the group consisting of a silicon comprising compound, an oil selected form the group consisting of castor, peanut, corn, palm, or tall oil and mixtures thereof, wherein the care booster composition is added during or before the washing cycle and is not itself a laundry detergent or fabric conditioner.

2. The method for reducing wrinkles in a fabric according to claim 1 wherein the fabric is clothing, and the washing process is carried out in a washing machine.

3. The method for reducing wrinkles in a fabric according to claim 1 wherein the ingredient effective for reducing wrinkles in a fabric is a non-hydrophobically or hydrophillically modified compound having a weight average molecular weight of at least about 150 and suitable for lubricating the fibers of a fabric.

4. The method for reducing wrinkles in a fabric according to claim 1 wherein the ingredient effective for reducing wrinkles in a fabric is a silicon comprising compound selected from the group consisting of a silane and a siloxane.

5. The method for reducing wrinkles in a fabric according to claim 4 wherein the siloxane is a linear polysiloxane.

6. The method for reducing wrinkles in a fabric according to claim 5 wherein the linear polysiloxane is an aminopolydimethylsiloxane.

7. The method for reducing wrinkles in a fabric according to claim 4 wherein the siloxane is a polysiloxane comprising in its backbone structural units of the formula:

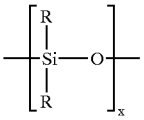

Wherein each R is independently a hydrogen, alkyl, aryl, alkenyl, alkaryl, arakyl, cycloalkyl, or halogenated hydrocarbon group.

8. The method for reducing wrinkles in a fabric according to claim 7 wherein at least one R is an amino, amide, saccharide group, carboxylic acid, ester, hydroxy, alkoxy, alkylene oxide sulfate, sulfonate, phosphate, phosphonate or monovalent betaine.

9. The method for reducing wrinkles in a fabric according to claim 1 wherein the care booster composition further comprises a dye fixing agent and a dye transfer inhibitor.

* * * * *